US009908747B2

(12) United States Patent
Matheisl et al.

(10) Patent No.: US 9,908,747 B2
(45) Date of Patent: Mar. 6, 2018

(54) CLADDING COMPONENT FOR AN ESCALATOR OR A MOVING WALKWAY

(71) Applicant: Inventio AG, Hergiswil (CH)

(72) Inventors: Michael Matheisl, Vösendorf (AT); Norbert Frim, Vienna (AT); Paul Sailer, Vienna (AT); Robert Schulz, Vienna (AT); Thomas Novacek, Schwechat (AT); Esteban Marks, Zürich (CH)

(73) Assignee: INVENTIO AG, Hergiswil (CH)

( * ) Notice: Subject to any disclaimer, the term of this patent is extended or adjusted under 35 U.S.C. 154(b) by 0 days.

(21) Appl. No.: 15/326,662

(22) PCT Filed: Jun. 30, 2015

(86) PCT No.: PCT/EP2015/064868
§ 371 (c)(1),
(2) Date: Jan. 17, 2017

(87) PCT Pub. No.: WO2016/008721
PCT Pub. Date: Jan. 21, 2016

(65) Prior Publication Data

US 2017/0210601 A1 Jul. 27, 2017

(30) Foreign Application Priority Data

Jul. 17, 2014 (EP) ..... 14177559

(51) Int. Cl.
*B66B 23/00* (2006.01)
*E04B 1/64* (2006.01)
*B21D 35/00* (2006.01)

(52) U.S. Cl.
CPC ..... *B66B 23/00* (2013.01); *B21D 35/001* (2013.01); *B21D 35/007* (2013.01)

(58) Field of Classification Search
CPC ..... B21D 35/001; B21D 35/007
(Continued)

(56) References Cited

U.S. PATENT DOCUMENTS 3,991,877 A * 11/1976 Kraft ..... B66B 23/22 16/220
4,488,631 A * 12/1984 Courson ..... B66B 23/22 198/335

(Continued)

FOREIGN PATENT DOCUMENTS

CN 2717908 Y 8/2005
CN 1907834 A 2/2007

(Continued)

*Primary Examiner* — Douglas A Hess
(74) *Attorney, Agent, or Firm* — William J. Clemens; Shumaker, Loop & Kendrick, LLP

(57) ABSTRACT

An escalator or a moving walkway has at least one interior space that is delimited relative to the environment of the escalator or the moving walkway by at least one cladding component. The at least one cladding component includes at least one multi-layer composite steel plate, wherein the at least one composite steel plate has at least one load-bearing layer of low-alloy steel and at least one cover layer of corrosion-resistant steel. The at least one cover layer is arranged at one of two side surfaces of the at least one composite steel plate. The at least one cover layer of the at least one cladding component when mounted on the escalator or the moving walkway is oriented towards the environment.

19 Claims, 5 Drawing Sheets

(58) Field of Classification Search
USPC ..... 198/321, 335, 337, 338, 860.3
See application file for complete search history.

(56) References Cited

U.S. PATENT DOCUMENTS 4,635,756 A 1/1987 Sherwood et al.
4,646,907 A * 3/1987 Streibig ..... B66B 23/22 198/335
4,736,884 A 4/1988 Tsuyama et al.
5,186,302 A * 2/1993 Johnson ..... B66B 23/22 198/335
5,307,919 A * 5/1994 Wente ..... B66B 23/22 198/335
5,355,990 A * 10/1994 Pitts ..... B66B 29/04 198/323
5,366,060 A * 11/1994 Johnson ..... B66B 29/04 198/323
5,421,076 A * 6/1995 Adrian ..... B66B 23/22 29/467
5,458,220 A * 10/1995 Nguyen ..... B66B 23/22 198/335
5,542,522 A * 8/1996 Adrian ..... B66B 23/22 198/337
6,006,889 A * 12/1999 Caron ..... B66B 29/04 198/335
6,814,215 B2 * 11/2004 Krampl ..... B66B 23/00 198/321
7,438,174 B2 * 10/2008 Aulanko ..... B66B 23/225 198/321
8,123,020 B2 * 2/2012 Fang ..... B66B 23/22 198/335
9,016,922 B2 * 4/2015 Matheisl ..... B66B 23/22 187/391
9,457,996 B2 * 10/2016 Winkler ..... B66B 23/22
2013/0163233 A1 6/2013 Niedermayer et al.

FOREIGN PATENT DOCUMENTS

CN 101565149 A 10/2009
EP 0208443 A2 1/1987
EP 2339085 A1 6/2011
GB 1061559 A 3/1967

* cited by examiner

CLADDING COMPONENT FOR AN ESCALATOR OR A MOVING WALKWAY

FIELD

The invention relates in general to an escalator or a moving walkway with at least one cladding component. The invention relates particularly to the construction of the cladding component of the escalator or moving walkway and possible methods of producing the cladding component.

BACKGROUND

Escalators or moving walkways comprise a load-bearing structure which is termed truss. This truss is usually a framework construction which is produced by the manufacturer as a whole unit or in truss modules. The truss or the truss modules or framework modules thereof are installed in a building, in which the truss connects, for example, two levels of the building. The movable components of the escalator or the moving walkway are arranged in the truss, for example a step belt or a plate belt, deflecting axles, a drive shaft as well as the drive motor with transmission, the control thereof, monitoring systems, safety systems and the like. In addition, stationary components such as, for example, balustrades with balustrade bases thereof, comb plates, bearing points, guide tracks and guide rails are also fixedly connected with the truss or framework.

Not only the truss, but also the balustrade bases are clad by means of cladding components and also the balustrade may have cladding components. Escalators with clad balustrades are usually so called high-load stairs used in, in particular, heavily frequented areas such as, for example, railway stations, underground stations and airports.

Through cladding the aforementioned components of a moving walkway or an escalator with cladding components an interior space is delimited relative to the environment of the escalator or the moving walkway. Consequently, the components arranged in this interior space are better protected from environmental influences such as, for example, dirt, water, snow and ice than if they were exposed. However, the cladding components also have the important function of preventing accidents, since apart from the forward run of the step or plate belt and the handrails they cover all movable components of the escalator or moving walkway.

For these reasons all escalators and moving walkways have cladding components which delimit at least an interior space of the escalator or the moving walkway relative to the environment. Some of these cladding components, for example skirt panels or coverings, which face towards the step belt, of the balustrade base and/or of the balustrade are exposed to constant mechanical loads by users, for example due to chaffing shoes or objects such as accompanying luggage. These coverings have to withstand shock-like loads as well such as impacts and kicking by vandals so as to be able to continue to guarantee safe operation of the escalator or the moving walkway.

Due to these requirements a corrosion-resistant steel plate or aluminum plate, which usually has a thickness of 1.5 millimeters to 4.0 millimeters, is used for producing these afore-described cladding components exposed to high levels of load.

Replacing this very expensive material by other materials such as for example, painted steel plates is a less satisfactory solution, since the paint coating is rubbed away even after a short period of time and the places rubbed clean not only impair the appearance of the escalator or the moving walkway, but also impart a less trustworthy image to users. Other materials such as, for example, plastics material sheets or aluminum plates are quickly scratched and worn due to their weak surface and also have to have a greater wall thickness in order to be able to withstand the same shock-like loads as cladding components made from a corrosion-resistant steel plate.

SUMMARY

An object of the present invention is therefore to create an escalator or a moving walkway, of which the cladding components can be produced more economically and which withstand the same loads just as well as cladding components made from corrosion-resistant steel plates.

This object is fulfilled by an escalator or a moving walkway with at least one interior space which is delimited relative to the environment of the escalator or the moving walkway by at least one cladding component. The cladding component comprises at least one multi-layer composite steel plate, wherein the composite steel plate comprises at least one load-bearing layer of low-alloy steel and at least one cover layer of corrosion-resistant steel. The at least one cover layer is arranged at one of the two side surfaces of the composite steel plate, wherein the at least one cover layer of the cladding component mounted on the escalator or moving walkway is oriented towards the environment. The principal constituent of the cladding component is the multi-layer composite steel plate, wherein the cladding component obviously can comprise other elements such as stiffening ribs, reinforcing plates, fastening means and the like. The individual layers all have the same area dimension, the layer construction and the layer thicknesses at every location of the composite steel plate thus being the same. However, both the layer construction and the layer thicknesses can differ at the edge regions and at cut edges of passages as a consequence of work processes.

A cladding component made of a composite steel plate has not just advantages in terms of costs. The cover layer consisting of corrosion-resistant steel is extraordinarily ductile and chaff-resistant due to its high content of chromium, so that by virtue of this material property and the layer thickness, which is greater by multiple compared with coatings, the cover layer cannot be worn by rubbing objects such as items of luggage and shoes or by dirt and small stones.

Moreover, the cladding component made from composite steel plates offers even more efficient protection relative to environmental influences than a cladding component made completely from corrosion-resistant steel, since the side surface which is directed towards the interior space and is usually the side surface of the load-bearing layer can be matched in the simplest way to the components arranged in the interior space. By contrast to corrosion-resistant steel, low-alloy steels can, in particular, be provided with a coating significantly more easily and more permanently.

The side surface of the load-bearing layer which is opposite to the cover layer can therefore be provided with a coating, preferably copper plating, tin plating, zinc plating or plastics-material coating. In mounted state, the coating is then oriented towards the interior space. Since some cladding components directly adjoin a truss or framework, the surface of which is usually hot-dip galvanized or provided with a zinc coating, the side surface of the load-bearing layer which is oriented towards the interior space is preferably provided with a zinc layer. Consequently it is possible to avoid corrosion problems at the contact points between the truss and the cladding component due to local formation of condensation, since the mutually contacting parts have the same potential in regard of the electrochemical series. The surface of the load-bearing layer can of course be provided with a coating even before joining together with the cover layer to form a composite steel plate.

There are various possibilities available for permanently joining together the load-bearing layer and the cover layer. For example, the composite steel plate can include a polymer layer which is arranged between the load-bearing layer and the cover layer and which firmly connects these together. This polymer layer additionally has a notably positive advantage. The truss provided with cladding components forms a resonance box having a resonance frequency which can lie in the range of the vibration frequencies arising during operation of the escalator or the moving walkway. As a result, damping mats and damping elements often have to be installed in order to reduce operating noise and vibrations, which are perceptible by users of the escalator or moving walkway. The polymer layer of the composite steel plate already has vibration-damping characteristics so that the cladding components already have sound-damping properties and in certain circumstances fewer or even no sound-damping measures are required. The thicker and more viscoplastic the polymer layer is the better are the damping characteristics of the cladding component. The polymer layer can have a thickness of 0.05 millimeters to 4.0 millimeters, preferably 0.5 millimeters to 2.5 millimeters.

The load-bearing layer and the cover layer can of course also be connected together by roll-bonding. In addition, several layers consisting of different materials can also be arranged one above the other on the load-bearing layer. For example, the side surfaces of the load-bearing layer can be hot-dip galvanized and the polymer layer and cover layer arranged on these hot-dip galvanized side surfaces. The load-bearing layer can, however, also be provided by means of an adhesive improvement coating such as a phosphate-coating. Moreover, a cover layer consisting of corrosion-resistant steel can also be arranged on each side surface of the load-bearing layer.

Depending on the respective mechanical requirements the cladding components can be made of composite steel plates of different thickness. The load-bearing layer can have, for example, a thickness of 0.5 millimeters to 3.5 millimeters, preferably 0.8 millimeters to 1.5 millimeters, and the cover layer can have a thickness of 0.03 millimeters to 1.5 millimeters, preferably 0.1 millimeters to 0.8 millimeters.

As already mentioned further above, the escalator or the moving walkway has at least one interior space which is delimited relative to the environment of the escalator or the moving walkway by at least one cladding component. However, this does not mean that the interior space is delimited relative to the environment just by one or more cladding components. At least the step belt of the escalator or the plate belt of the moving walkway similarly delimits the interior space from the environment, even though system-dependent gaps are present through which moist air, water and dirt can penetrate into the interior space.

The truss, parts of at least one balustrade base and/or parts of at least one balustrade can, for example, be arranged in the at least one interior space of the escalator or moving walkway. An escalator or a moving walkway can obviously also have several interior spaces so that not all parts of the escalator or the moving walkway are arranged in the same interior space.

The composite steel plate can obviously have at least one passage for reception of fastening means. The at least one passage can be produced by means of a punching die, which penetrates the composite steel plate under pressure with shearing effect and punches out the passage. Depending on the respective design of the punching die the cover layer can also be entrained here. The cut edge, which is formed by the punching out of the passage can therefore be at least partly covered by the cover layer of the composite steel plate.

However, the at least one passage can also be produced by means of a punching die which penetrates the composite steel plate under pressure with shearing effect and punches out the passage and by means of a stamping die which subjects the passage to cold deformation with stamping effect at least at the cut edge. Through these production methods it is possible that the cut edge of the passage, which is formed by the punching out, can be almost completely covered after the stamping by the cover layer of the multi-layer composite steel plate which consists of corrosion-resistant steel. The stamping die can also form further contours in the region of the passage, for example a countersinking for the head of a screw serving as fastening means, a projection serving as a spacer and directed towards the interior space or a corrugation directed towards the interior space and encircling the passage, and the like. A cover layer covering the cut edge of the passage prevents the load-bearing layer from possibly corroding in the region of the cut edge.

One possible method for punching/stamping a passage of the aforesaid kind in a composite steel plate of an escalator or a moving walkway can comprise the steps of initially punching out the passage by a punching die which penetrates the composite steel plate under pressure with shearing effect. In a second step, the passage can then be subjected to cold deformation at the cut edge by stamping by means of a stamping die, wherein after the stamping the cut edge, which is formed by the punching out, of the passage is covered by a cover layer of the composite steel plate. The stamping die thus presses the cover layer, which is present in the region of the cut edge, through the passage up to the side surface of the composite steel plate, which in mounted state is directed towards the interior space of the escalator or the moving walkway. The cut edges can of course also be sealed by other means, for example by a drop of silicon sealant or an adhesive.

Particularly precise and rapid production of the passages can take place if the stamping die engages concentrically around the punching die and the two dies can be displaced independently of one another in axial direction. As a result, the passages do not have to be produced by two mutually separate tool stations.

The edges of the composite steel plate can have cut edges which are also covered at least partly by the cover layer of the composite steel plate. As a result, as already explained in connection with the cut edge, corrosion of the cut edges is at least reduced.

One possible method of producing cut edges of the aforesaid kind at a composite steel plate of an escalator or a moving walkway can comprise the step that a cutting tool having a fixed cutter and a movable cutter is present. The fixed cutter and the movable cutter execute an oblique cutting movement under pressure with shearing effect, which movement extends at a shearing angle to the vertical or to the perpendicular direction of the side surface of the composite steel plate, so that during shearing the cover layer is entrained by the movable cutter and thereby the cut edge, which is formed by the shearing, of the composite steel plate is covered by the entrained cover layer of the composite steel plate.

The shearing angle α can be 0° to 30° with respect to the vertical direction. In order to assist entrainment of the cover layer during shearing a chamfer can be formed at the cutting edge of the movable cutter, the chamfer angle of the chamfer is oriented at −90° to 15° to the vertical direction or perpendicular to a side surface of the composite steel plate. The chamfer height of the chamfer can be 0 to 3 millimeters. Since corrosion-resistant steel has a high breaking elongation this material is particularly well suited to be drawn over the cut edge by means of the aforesaid method.

DESCRIPTION OF THE DRAWINGS

An escalator or a moving walkway with cladding components and, in particular, the construction of the cladding components made substantially from composite steel plate are explained in more detail by way of an escalator and moving walkway and with reference to the drawings, in which.

DETAILED DESCRIPTION

Figure 1:
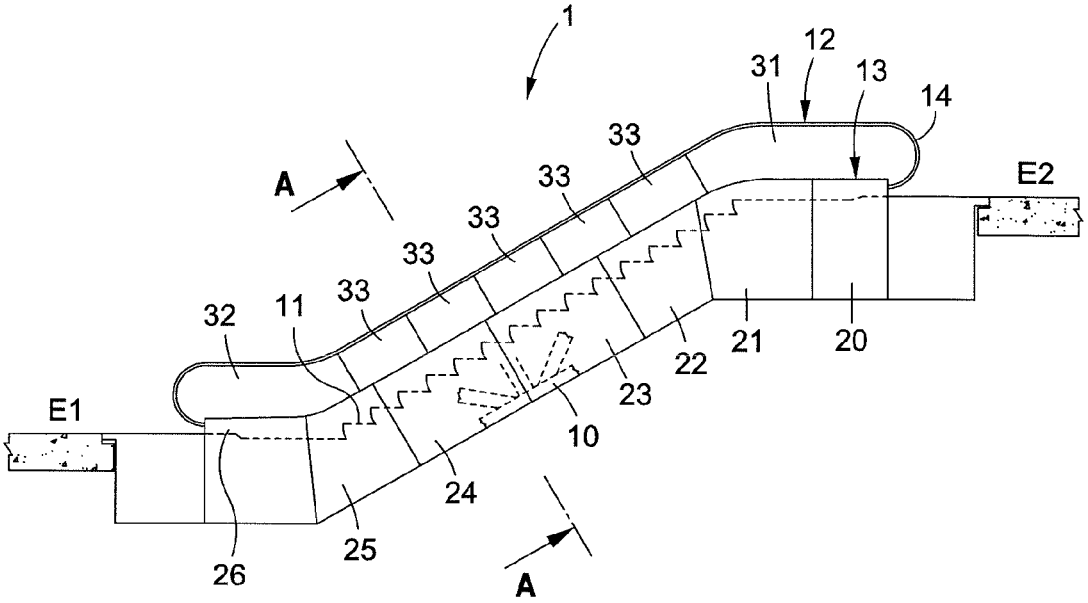
FIG. 1 shows schematically a side elevation view of an escalator with a support structure which is clad by cladding components and with balustrades clad by cladding components.

A side elevation view of an escalator 1 with a truss 10 or framework 10 is illustrated in FIG. 1. The escalator 1 connects a lower plane E1 with an upper plane E2. Arranged in the truss 10 is an encircling step belt 11 which is deflected in the upper plane E2 and in the lower plane E1 and thus has a forward running section and a return running section. For the sake of better clarity, illustration of the return running section was dispensed with as well as illustration of frames, guide rails, guide tracks, rail blocks and a drive unit. The escalator 1 further comprises two balustrades 12 which extend along each longitudinal side of the step belt 11, wherein only the balustrade 12 at the front in the viewing plane is visible in FIG. 1. A handrail 14 is arranged at each balustrade 12 to circulate, wherein the return running section of the handrail is arranged in a balustrade base 13 connecting the balustrade 12 with the truss 10. At least one side of the truss 10 is clad with several cladding components 20, 21, 22, 23, 24, 25, 26. The cladding components 20, 21, 22, 23, 24, 25, 26 extend in height above the truss 10 and the balustrade base 13 and are made substantially from composite steel plate. The balustrade 12 can also be clad with cladding components 31, 32, 33 of composite steel plates.

Figure 2:
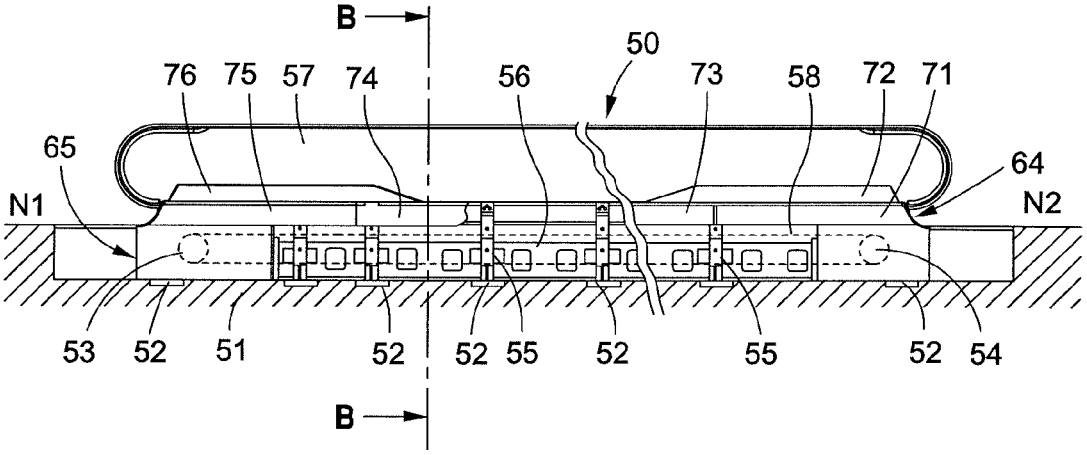
FIG. 2 shows schematically a side elevation view of a moving walkway with a truss clad by cladding components and with transparent balustrades which are respectively connected with the truss by a balustrade base which is clad by cladding components.

FIG. 2 shows, in side view and in schematic illustration, a moving walkway 50 arranged on a supporting structure 51. Serving as supporting structure 51 is a floor with pit 65, which has sufficient strength. The moving walkway can obviously also be mounted on a different supporting structure, for example on a framework which connects two floors of a building, on girders and the like.

The moving walkway 50 can be mounted on a flat floor without a pit 65 if it is arranged between two ramps. The two ramps are recommended so that users can conveniently access the height or level of the plate belt 58 of the moving walkway 50.

The floor 51 has mounts 52 to which the components of the moving walkway 50 are fastened. Belonging to these mounts are a first deflecting region 53 and a second deflecting region 54 as well as support structures 55, guide rails 56, balustrades 57 each having a balustrade base 64 and the encircling plate belt 58 arranged between the deflecting regions 53, 54. Since the moving walkway 50 is partially arranged in the pit 65, only the part which protrudes above the floor level N1-N2 of the floor 51, of the moving walkway 50 has to be clad with cladding components 71, 72, 73, 74, 75, 76.

Figure 3:
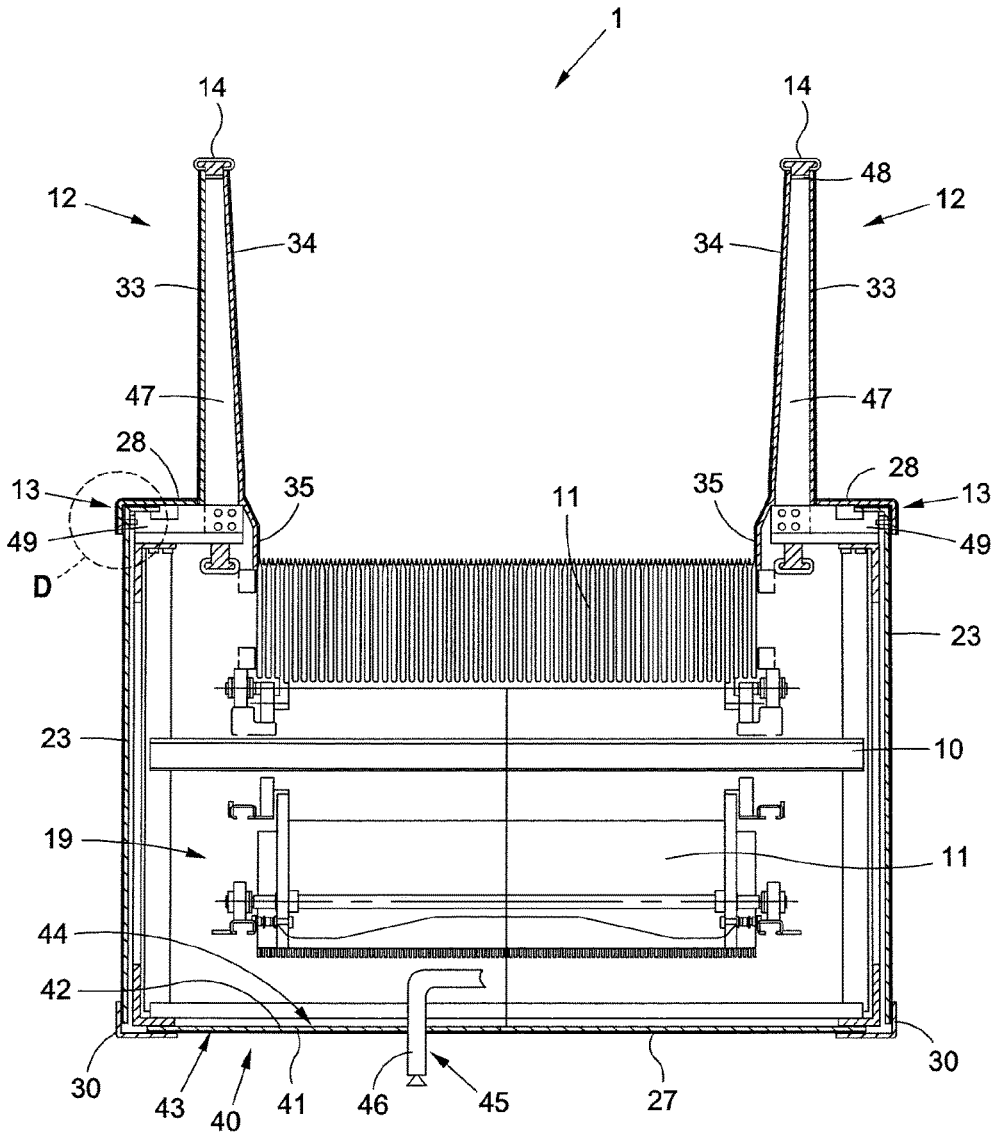
FIG. 3 shows the escalator of FIG. 1 in the cross-section A-A.

FIG. 3 shows the cross-section A-A, which is indicated in FIG. 1, of the escalator 1. The arrangement of the step belt 11 in the truss 10 or framework 10 and the fastening of the two balustrades 12, which are connected with the truss 10 by means of the balustrade base 13, can be readily seen in this FIG. 3. In addition, the guidance of the handrail 14 at the upper side of the balustrades 12 and within the balustrade base 13 is evident. As the section A-A shows, the truss 10, the balustrade base 13 and balustrades 12 are clad with cladding components 23, 27, 28, 33, 34, 35 so that an interior space 19 is delimited by the cladding components 23, 27, 28, 33, 34, 35 and the step belt 11 relative to the environment of the escalator 1.

Each of these cladding components 23, 27, 28, 33, 34, 35 comprises at least one multi-layer composite steel plate 40, wherein the composite steel plate 40 includes at least one load-bearing layer 42 of low-alloy steel and a cover layer 41 of corrosion-resistant steel. For reasons of clarity only the cladding component 27 serving as bottom layer is provided with the corresponding reference numeral. The cover layer 41 is arranged at one of the two side surfaces 43, 44 of the composite steel plate 40. The load-bearing layer 42 does not necessarily have to be of the same strength or thickness in all cladding components 23, 27, 28, 33, 34, 35. The thickness or strength thereof can be selectably adapted to the respective anticipated loads. Thus, for example, the load-bearing layer of the cladding component 34, which is directed towards the step belt 11, of the balustrade 12 can be thicker than the load-bearing layer 42 of the cladding component 27 serving as bottom layer, because in the region of the balustrades 12 substantially greater loads such as, for example, shocks and impacts from users are to be expected. In the mounted state, the cover layers 41, which consist of corrosion-resistant steel, of all cladding components 23, 27, 28, 33, 34, 35 are directed towards the environment of the escalator 1.

The cladding components 23, 27, 28, 33, 34, 35 can also have passages 45 as required. The passage 45 illustrated in FIG. 3 enables passing of a sprinkler head 46 through the cladding component 27. The sprinkler head 46 is part of a sprinkler installation (not illustrated in more detail).

The balustrade 12 comprises an inner structure 47 or balustrade parts 47 which supports or support a handrail guide 48 of the handrail 14. In addition, the cladding components 33, 34 arranged in the section A-A are fastened to the inner structure 47. The balustrade base 13 also comprises base parts 49 which are made from steel sections and to which the cladding components 35, which serve as base plates, and the cladding components 28, which serve as coverings, are fastened. In order to obtain cleanly designed corner terminations angle sections 30 can be arranged between the lateral cladding components and the cladding component 27 serving as bottom layer, which sections preferably extend in length over a plurality of mutually adjacent cladding components 23 and 27. These angle sections 30 can similarly be made of, for example, composite steel plate, but also from corrosion-resistant steel plate, also known by the designations stainless steel, NIROSTA steel plate (registered trademark of Thyssenkrupp Nirosta GmbH of Krefeld, Germany) and INOX steel plate.

Figure 4:
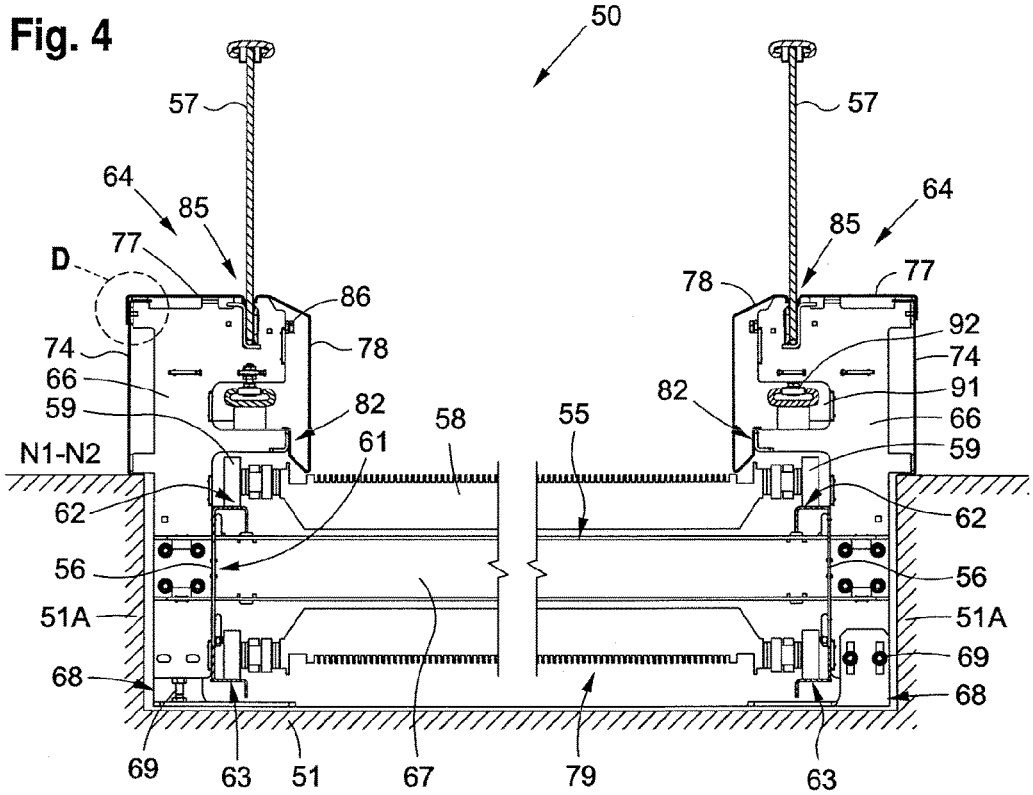
FIG. 4 shows the moving walkway of FIG. 2 in the cross-section B-B.

FIG. 4 illustrates the cross-section B-B of the moving walkway 50 as indicated in FIG. 2. The supporting structure 55, guide rails 56 and plate belt 58 correspond with the components illustrated in FIG. 2, for which reason these have the same reference numerals.

The support structure 55 comprises two supports 66, which are rigidly connected together by a transverse strut 67. The terms "lower" and "upper" used in the following define the position of the fastening regions at the support 66 in the installed state and are referred to the direction of gravitational force. A foot fastening region 68 is formed at the support 66 at the lower end. This region has a height-adjusting device 69 in order to compensate for unevennesses or level differences of the supporting structure 51. Above the foot fastening region 68 the support 66 has a rail fastening region 61 to which the guide rail 56 is fastened.

The guide rail 56 is of C-shaped construction in cross-section with respect to its length direction and includes not only an upper guide track 62 for the plate belt section of the forward run, but also a lower guide track 63 for the plate section of the return run. A respective plate of the forward run and plate of the return run of the plate belt 58, which are laterally connected with roller chains 59, are illustrated between the guide rails 56. The roller chains 59 run by the rollers thereof on the guide tracks 62 and 63.

The base fastening regions 82, which are formed at the support 66 and to which a cladding component 78 serving as a base plate is fastened, can also be readily seen in FIG. 4. The balustrade fastening regions 85 with the clamping devices 86 arranged thereat for mounting the two balustrades 57 are also illustrated. In the present embodiment the two balustrades 57 are designed as glass balustrades such as used in, for example, escalators 1 and moving walkways 50 in department stores or airports. A handrail-guide fastening region 91, to which guide parts such as the illustrated handrail-guide roller 92 can be fastened, is formed at the support 66 above the rail fastening region 61. Handrail-guide rails can obviously also be mounted on these handrail-guide fastening regions 91.

In addition, further parts of the balustrade base 64 such as the cladding components 74 and 77 are fastened to the supports 66 of the support structure 55. As the section B-B shows, the support structures 55 up to the floor level N1-N2 and the balustrade base 64 are clad with the cladding components 74, 77, 78, so that an interior space 79 is delimited relative to the environment of the moving walkway 50 by the cladding components 74, 77, 78 as well as by the pit walls 51A of the fixed structure 51 and the plate belt 58.

Figure 5:
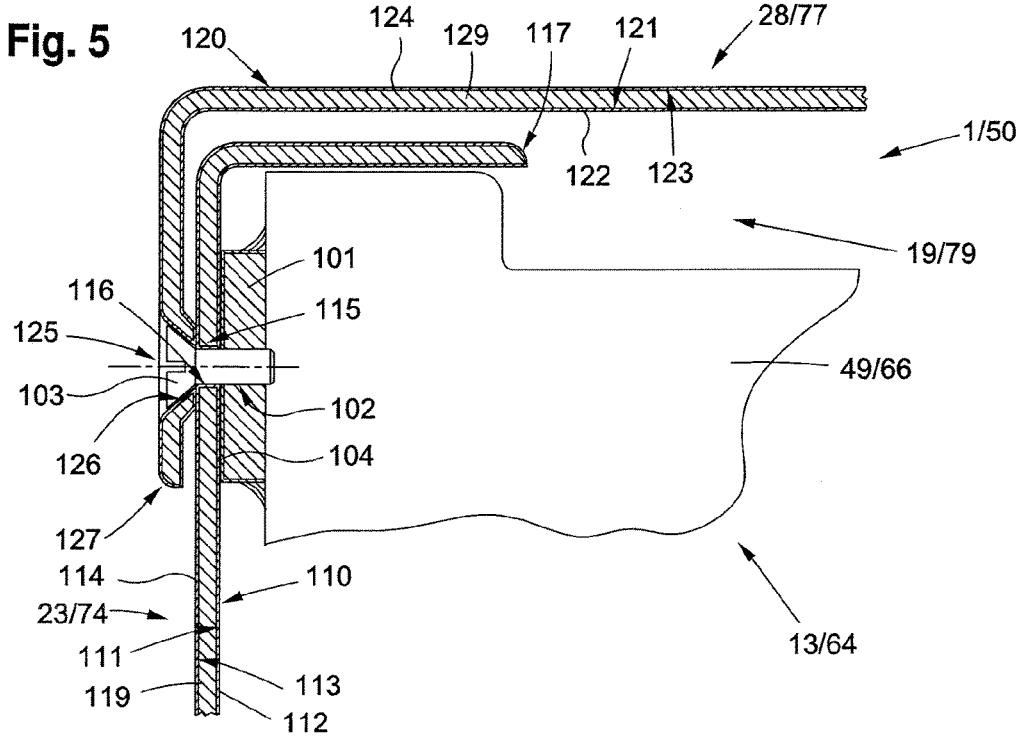
FIG. 5 shows the detail, which is denoted in FIG. 3 and FIG. 4 by D, in enlarged illustration.

The detail denoted in FIG. 3 and FIG. 4 by "D" is illustrated to enlarged scale in FIG. 5, so that the layer sequences of the cladding components 28/77, 23/74 made from composite steel plates 110, 120 can be better seen. Since FIG. 5 shows not only a detail D of the escalator 1, but also a detail D of the moving walkway 50, the individual components are, where necessary, respectively provided with two reference numerals separated by a slash, in which the first reference numeral is associated with the escalator 1 and the second reference numeral with the moving walkway 50.

The detail D shows a corner of the balustrade base 13/64 of the escalator 1 or moving walkway 50. A mounting plate 101 having a threaded bore 102 for mounting a countersunk-head screw 103 is welded to the base part 49 or to the support 66. The mounting plate 101 can obviously also be screw-connected with, clinched or riveted to, or quite simply integrally formed at the base part 49 or the support 66.

A cladding component 28/77 serving as covering and a cladding component 23/74 serving as side wall are fastened to the mounting plate 101 by means of the same countersunk-head screw 103. In logical manner, a row of countersunk-head screws 103 at predetermined spacings is provided in the length direction of the moving walkway 50 or the escalator 1 in order to fasten the two cladding components 23/74, 28/77.

The cladding component 23/74 bearing against the mounting plate 101 and serving as side wall is made from a composite steel plate 110 which comprises a load-bearing layer 119 of low-alloy steel, for example of a carbon steel. A coating 112, preferably a zinc layer, is coated on its side surface 111 directed towards the interior space 19/79, for example by hot-dip galvanizing, powder-coating, electroplating methods or spraying a paint with zinc content. Since the mounting plate 101 is also protected by means of a zinc layer 104 from the influences of corrosion, two components, the surfaces of which do not have any potential difference with respect to electrochemical series, bear against one another. The coating 112 can obviously also be a tin layer or plastics material layer.

The side surface 113, which is directed towards the surroundings of the escalator 1 or the moving walkway 50, of the cladding component 23/74 has a cover layer 114 of corrosion-resistant steel, for example high-alloy chromium-nickel steel, which is connected with the load-bearing layer 119 by, for example, a polymer layer. The polymer layer of the aforesaid kind has to have viscoplastic properties so that the composite steel plate 110 can also be cold-shaped without the individual layers 119, 114 detaching from one another (delaminating). For example, use can be made of a mixture of a first dispersion, which contains natural rubber, with an acryl acid ester copolymer and a colloidal second dispersion of a chloropropene polymer for adhesion of the load-bearing layer 119 and the cover layer 114. In addition, epoxy resins or polyurethane adhesives or compounds cross-linked in moist state to form elastomers are also suitable for the intended purpose of use. The cover layer 114 can obviously also be connected with the load-bearing layer 119 by means of roll-bonding.

The cladding component 28/77 serving as cover of the balustrade base 13/64 is made from a composite steel plate 120 which has a respective cover layer 122, 124 of corrosion-resistant steel on each of its two side surfaces 121, 123 of its load-bearing layer 129 made from low-alloy steel. As already described above, the two cover layers 122, 124 can be glued to the load-bearing layer 129 or connected by means of roll-bonding. Since the two cladding components 28/77 and 23/74 are in contact in the region of the countersunk-head screw 103 by their cover layers 114, 122 made of corrosion-resistant steel there is also no potential difference here with respect to the electrochemical series. The countersunk-head screw 103 is preferably also made from corrosion-resistant steel.

Since the two cladding components 28/77, 23/74 are fastened to the mounting plate 101 by means of a countersunk-head screw 103, each has a passage 115, 125 associated with this countersunk-head screw 103. The passage 125 of the cladding component 28/77 serving as covering has a shaped portion which is formed to be conical by stamping and which receives the head of the countersunk-head screw 103 so that this does not protrude. The cut edges 116, 126 of the two passages 115, 125 are covered by the respective cover layer 114, 124. Accordingly, the passage 115 of the cladding component 23/74 serving as side wall is also conically formed. The cut edges 117/127 at the edge regions of the cladding components 28/77, 23/74 are also respectively covered by the cover layer 114, 124 directed towards the environment. Two examples of how the cut edges covered by the cover layer can be produced are described in the following.

Figure 6A:
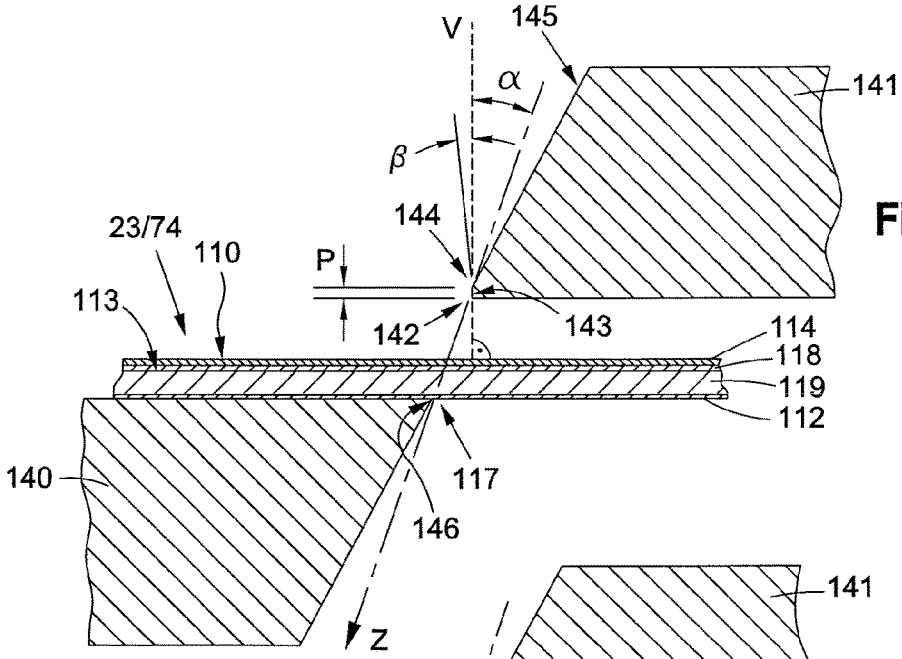
FIGS. 6A-6C show different production steps for producing covered cut-edges of a composite steel plate.
Figure 6B:
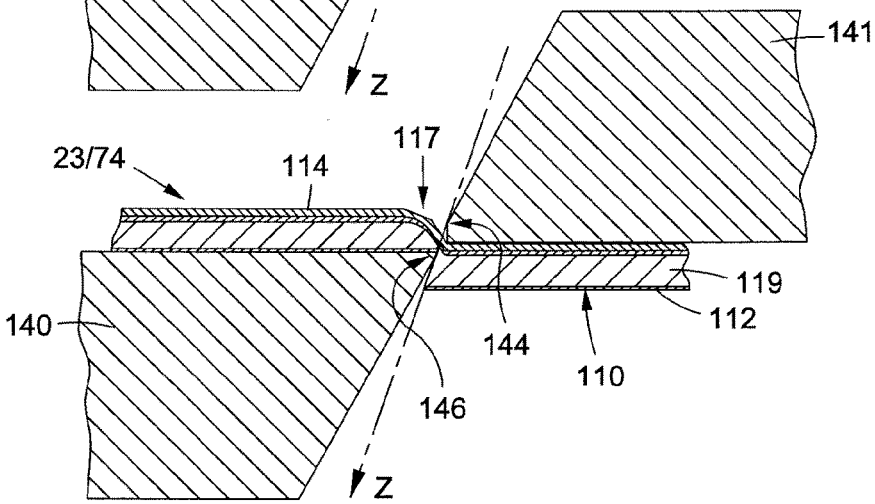
Figure 6C:
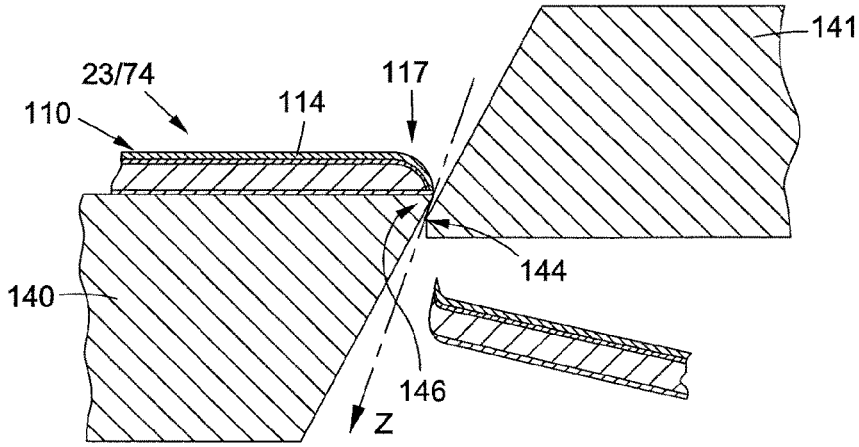

FIGS. 6A to 6C show, by way of the cladding component 23/74 described in FIG. 5, different stages of possible production of covered cut edges 117 in the edge regions thereof.

Illustrated in these FIGS. 6A to 6C are not only the load-bearing layer 119, cover layer 114 and coating 112, but also the polymer layer 118 firmly connecting the cover layer 114 with the load-bearing layer 119. Merely a fixed cutter 140 and a movable cutter 141 of the cutting tool shown in FIGS. 6A to 6C are illustrated. In principle, this cutting tool barely differs from conventional plate shears. However, during shearing the movable cutter 141 executes relative to the fixed cutter 140 an oblique cutting movement Z at a shearing angle $\alpha$ with respect to the vertical V or normal V of the side surface 113 or to the thickness of the composite steel plate 110 of the cladding component 23/74.

As illustrated in FIG. 6A, a chamfer 143 is formed at the cutting edge 142 of the movable cutter 141. The chamfer 143 has a chamfer height P and is arranged at a chamfer angle $\beta$ with respect to the thickness of the composite steel plate 110, or with respect to the vertical V of the side surface 113, at the cutting edge 142 of the movable cutter 141. A chamfer edge 144 is present between the chamfer 143 and the release 145 of the movable cutter 141 and taking account of the cutting movement Z is oriented precisely towards a sharp cutting edge 146 of the stationary cutter 140.

In order to produce optimum coverage of the cut edge 117 the chamfer height P and the chamfer angle $\beta$ thereof have to be matched to the material characteristics of the composite steel plate 110 to be cut and the shearing angle $\alpha$, in which case the ideal values can be determined empirically by means of experiments. In that case the shearing angle $\alpha$ can be selected to be 0° to 30°, the chamfer angle $\beta$ to be −90° to 14° and the chamfer height P to be 0 to 2 millimeters. The shearing angle $\alpha$ is preferably 5° to 20°, the chamfer angle $\beta$ −85° to −60° and the chamfer height P 0.5 millimeters to 1.0 millimeters. Starting from the vertical V or normal V orthogonal to the side surface 113 the angle values in clockwise sense are indicated by a positive sign and the angle values in anticlockwise sense by a negative sign.

As illustrated in FIG. 6B due to the oblique cutting movement Z and the chamfer 143 the cover layer 114 is not smoothly cut through when sheared, but it is entrained by the movable cutter 141 during the shearing. Since the fixed cutter 140 has a sharp-edged cutting edge 146 the coating 112 and the load-bearing layer 119 are cut through there until the chamfer edge 144 draws past the cutting edge 146.

When the chamfered edge 144 and the cutting edge 146 impinge, the cover layer 114, which due to the drawing action has also become substantially thinner in this region, is also cut through, as illustrated in FIG. 6C. Through the entrainment of the cover layer 114 the cut edge 117, which is formed by the shearing, of the composite steel plate 110 is covered or coated by the cover layer 114 of the composite steel plate 110. Since corrosion-resistant steel has a high breaking elongation this material is extremely well suited to being drawn over the cut edge 117 by the aforesaid method. Depending on the respective material characteristics of the polymer layer 118 employed this can break or tear in the region of the cut edges 117 during the punching or cutting. In order to prevent penetration of moisture into the polymer layer 118 the cut edge 117 can be sealed with the same polymer material, for example by dipping or spraying.

The contours of the parts, which consist of composite steel plate 110, of a cladding component 23/74 can obviously also be formed by water-jet cutting or by laser cutting. If the cut edges 117 processed in that manner are to be similarly covered by the cover layer 114 the cover layer 114 can be rolled over the cut edge 117, for example by means of a rolling tool, or pressed or drawn over the cut edge 117 by means of a press tool. However, the cut edge 117 can also be liquid-tightly covered by a self-adhesive sealing strip or a curable polymer layer applied in liquid form. The same obviously also applies to the cut edges 127 of the cladding component 28/77.

Figure 7A:
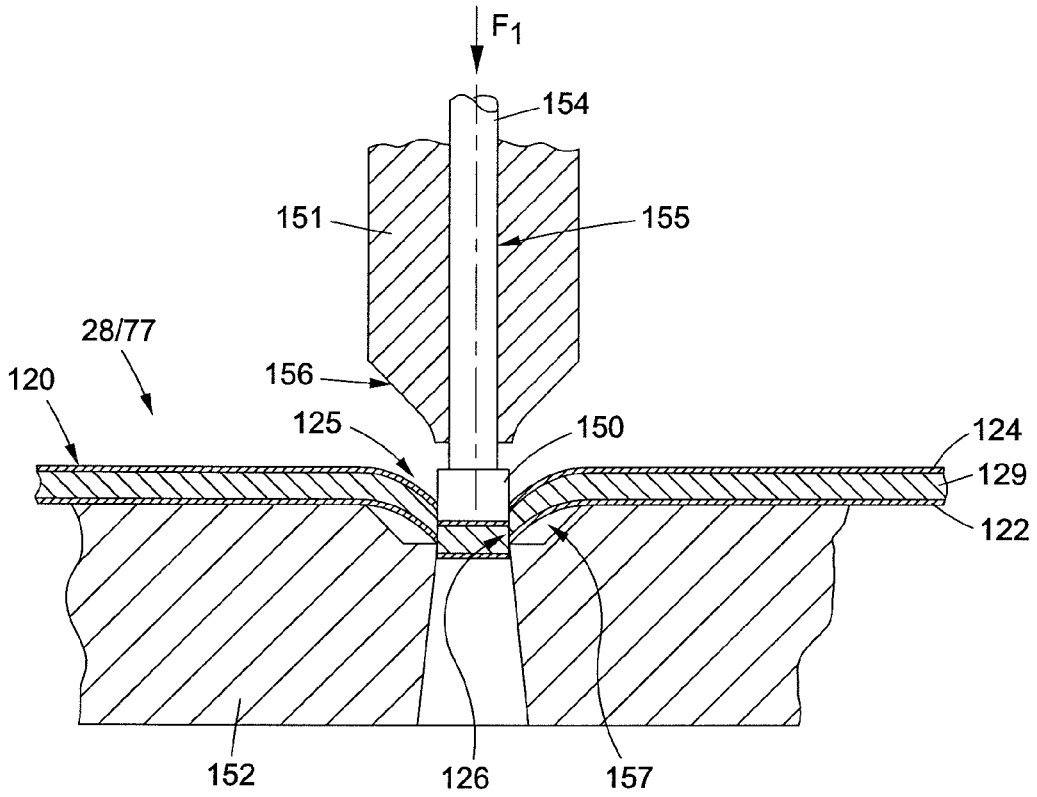
FIGS. 7A and 7B show different production steps for producing passages with a covered cut edge in a composite steel plate.
Figure 7B:
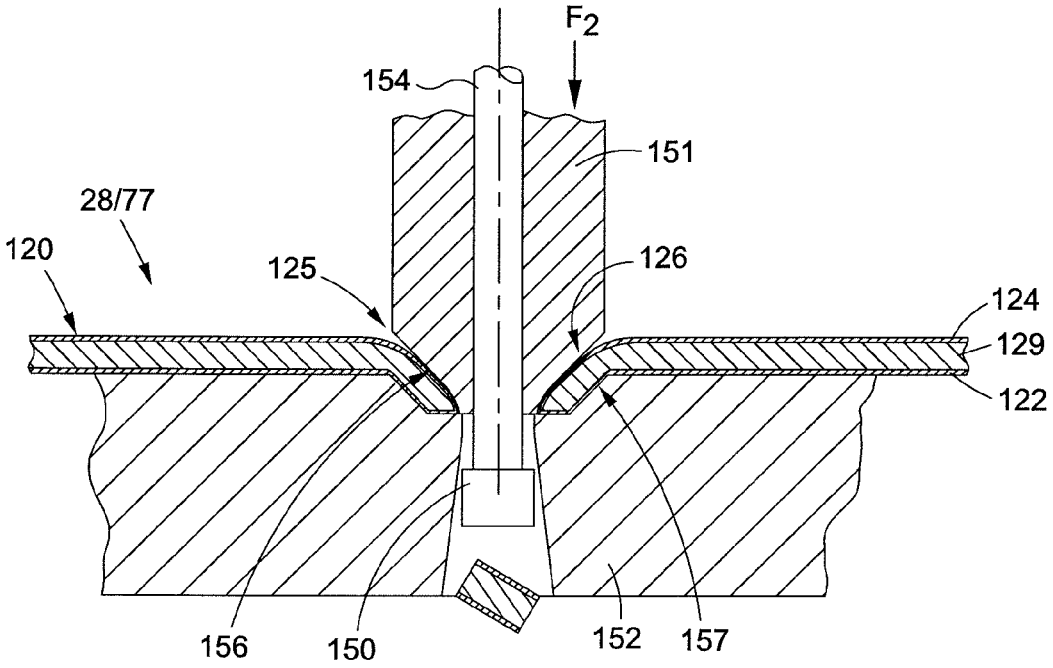

FIGS. 7A and 7B show different steps of production of a covered cut edge 126 of the passage 125 on the basis of the cladding component 28/77 described in FIG. 5.

In order to produce the passage 125 the tool comprises a punching die 150, a stamping die 151 and a sink die plate 152. The composite steel plate 120 of the cladding component 28/77 is placed and aligned on the sink die plate 152. The passage 125 is subsequently punched out by means of the punch die 150 as symbolized in FIG. 7A by the arrow in axial direction $F_1$. Since in the present example a passage 125 for a countersunk-head screw is to be created, this passage 125 has a circular cross-sectional area, for which reason the punching die 150 and the stamping die 151 are of rotationally symmetrical construction. The stamping die 151 is of tubular construction with the shank 154 of the punching die 150 arranged in the bore 155 of the stamping die 151. Through this arrangement the stamping die 151 is linearly guided by the shank 154.

In a further step, which is symbolized in FIG. 7B by the arrow in axial direction F2, after use of the punching die 150 the stamping die 151 is advanced towards the sink die plate 152. The stamping die 151 has a stamping surface 156 in order to press the material of the composite steel plate 120 into a recess 157 of the sink die plate 152. In that case the load-bearing layer 129 is deformed in the region of the passage 125 in such a way that a conical receptacle for the screw head arises. In addition, the cover layer 124 facing the stamping die 151 is drawn over the cut edge 126 produced beforehand by the punching die 150 and thus the cut edge 126 is covered by the cover layer 124.

Depending on the respective material characteristics of the polymer layer used this can break or tear in the region of the deformed cut edge 126 during punching/stamping. In order to prevent penetration of moisture between the load-bearing layer 129 and the cover layer 124, 122 this location can be sealed by means of a silicon sealing compound when, for example, fitting the screw.

Although the invention has been described in detail on the basis of two cladding components of the corner region of a balustrade base it is obvious that all other cladding components of an escalator or a moving walkway can be constructed in the same way. Obviously, that not all cladding components have to be made from composite steel plate 40, 110, 120. Thus, for example, the cladding components 23, 27, which are illustrated in FIG. 3, of the truss 10 can be painted cladding components of low-alloy steel or constructional steel, whilst the cladding components 28, 35 covering the balustrade base 13 are made of composite steel plates. Moreover, instead of the proposed deformation of the cover layer in the region of the cut edges, the cut edges of the composite steel plates can also be sealed by a sealing compound or an adhesive so that the load-bearing layer is not exposed to environmental influences and corroded at these locations. The cut edges can obviously also be flanged in the edge regions relative to the interior space so that the cut edges are protected as far as possible from environmental influences.

In accordance with the provisions of the patent statutes, the present invention has been described in what is considered to represent its preferred embodiment. However, it should be noted that the invention can be practiced otherwise than as specifically illustrated and described without departing from its spirit or scope.

The invention claimed is:

1. An escalator or a moving walkway having at least one interior space that is delimited relative to an environment of the escalator or the moving walkway by at least one cladding component, comprising:

the at least one cladding component including a multi-layer composite steel plate, wherein the composite steel plate has a load-bearing layer of low-alloy steel and a cover layer of corrosion-resistant steel, the cover layer being arranged at one of two side surfaces of the composite steel plate and the cover layer being oriented towards the environment when the at least one cladding component is mounted on the escalator or the moving walkway.

2. The escalator or the moving walkway according to claim 1 wherein a side surface of the load-bearing layer that is opposite the cover layer is provided with a coating and the coating is directed towards the interior space when the at least one cladding component is mounted on the escalator or the moving walkway.

3. The escalator or the moving walkway according to claim 2 wherein the coating is one of a tin plating, a copper plating, a zinc plating and a plastics material.

4. The escalator or the moving walkway according to claim 1 wherein the composite steel plate includes a polymer layer arranged between and connecting together the load-bearing layer and the cover layer.

5. The escalator or the moving walkway according to claim 4 wherein the polymer layer has a thickness in a range of 0.05 millimeters to 4.0 millimeters.

6. The escalator or the moving walkway according to claim 4 wherein the polymer layer has a thickness in a range of 0.5 millimeters to 2.5 millimeters.

7. The escalator or the moving walkway according to claim 1 wherein the load-bearing layer and the cover layer are connected together by roll-bonding.

8. The escalator or the moving walkway according to claim 1 wherein the load-bearing layer has a thickness in a range of 0.5 millimeters to 3.5 millimeters and the cover layer has a thickness in a range of 0.03 millimeters to 0.5 millimeters.

9. The escalator or the moving walkway according to claim 1 wherein the load-bearing layer has a thickness in a range of 0.8 millimeters to 1.5 millimeters and the cover layer has a thickness in a range of 0.1 millimeters to 0.3 millimeters.

10. The escalator or the moving walkway according to claim 1 wherein at least one of a truss, a supporting structure, parts of a balustrade base and parts of a balustrade is arranged in the at least one interior space.

11. The escalator or the moving walkway according to claim 1 wherein the at least one cladding component has a passage formed therein.

12. The escalator or the moving walkway according to claim 11 wherein the passage is formed with a punching die, which die penetrates under pressure with shearing effect into the composite steel plate of the at least one cladding component and punches out the passage, wherein a cut edge that is formed by the punching out of the passage is at least partly covered by the cover layer of the composite steel plate.

13. The escalator or the moving walkway according to claim 11 wherein the passage is formed with a punching die, which die penetrates under pressure with shearing effect into the composite steel plate of the at least one cladding component and punches out the passage forming a cut edge, and with a stamping die that subjects the passage at least at the cut edge to cold deformation by stamping whereby after the cut edge is covered by the cover layer of the composite steel plate.

14. The escalator or the moving walkway according to claim 1 wherein the composite steel plate of the at least one cladding component has cut edges that are at least partly covered by the cover layer of the composite steel plate.

15. A method for punching/stamping a passage in the composite steel plate of the at least one cladding component of the escalator or the moving walkway according to claim 1, comprising the steps of:

applying pressure to a punching die to penetrate with shearing effect into the composite steel plate and punch out the passage with a cut edge; and operating a stamping die to subject the passage at the cut edge to cold deformation by stamping whereby the cut edge of the passage is covered by the cover layer of the composite steel plate.

16. The method according to claim 15 wherein the stamping die engages concentrically around the punching die and the two dies are displaceable independently of one another in an axial direction.

17. A method of producing a cut edge in the composite steel plate of the at least one cladding component of the escalator or the moving walkway according to claim 1, comprising the steps of:

providing a cutting tool having a fixed cutter and a movable cutter wherein the fixed cutter and the movable cutter execute an oblique cutting movement under pressure with shearing effect, which cutting movement runs at a shearing angle in respect of a vertical direction; and operating the cutting tool with the vertical direction perpendicular to a side surface of the composite steel plate such that during the cutting movement the cover layer is entrained by the movable cutter and thereby the cut edge that is formed by the shearing effect is at least partly covered by the cover layer of the composite steel plate.

18. The method according to claim 17 wherein the shearing angle is in a range of 0° to 30° and a chamfer formed at a cutting edge of the movable cutter is oriented in a range of −90° to 15° in respect to the vertical direction.

19. The method according to claim 18 wherein a height of the chamfer is in a range of 0 millimeters to 2 millimeters.

* * * * *